United States Patent [19]

Russell

[11] 4,217,629

[45] Aug. 12, 1980

[54] CORNER LIGHTING ASSEMBLY

[76] Inventor: James P. Russell, 123 Park Ave., Verona, N.J. 07044

[21] Appl. No.: 6,884

[22] Filed: Jan. 26, 1979

Related U.S. Application Data

[63] Continuation of Ser. No. 784,137, Apr. 4, 1977, abandoned.

[51] Int. Cl.[2] ..... F21S 1/14; F21S 3/06; F21V 21/00

[52] U.S. Cl. ..... 362/147; 362/150; 362/370; 362/396; 362/432

[58] Field of Search ..... 362/432, 219, 227, 370, 362/389, 396, 404, 147, 148, 150, 151

[56] References Cited

U.S. PATENT DOCUMENTS

| | | | |
|---|---|---|---|
| 1,249,500 | 12/1917 | Richter | 362/147 |
| 1,900,436 | 3/1933 | Dourgnon | 362/147 |
| 2,428,827 | 10/1947 | Beck | 362/219 |
| 2,520,503 | 8/1950 | Henning | 362/389 |
| 2,640,670 | 6/1953 | Lampe | 362/432 |
| 2,800,577 | 7/1957 | Block | 362/227 |

*Primary Examiner*—Samuel W. Engle
*Assistant Examiner*—Donald P. Walsh
*Attorney, Agent, or Firm*—Watson, Leavenworth, Kelton & Taggart

[57] ABSTRACT

A corner bracket having a cross member and mounting arms at right angles with each other is arranged to be fastened at any desired height in a corner of a room. A lamp housing interengages with the bracket snugly in the corner and has right angled rear walls and a downwardly directed configuration including an interiorly contained screw socket. A bulb for fostering plant growth fits in the socket entirely within the housing. A lamp cord depends from the rear of the housing while corner molding is provided for decoratively concealing the lamp cord between the housing and the floor of the room.

12 Claims, 9 Drawing Figures

10
11
12
13
14
15
16
17
24
25
26
2
2

Fig. 3.
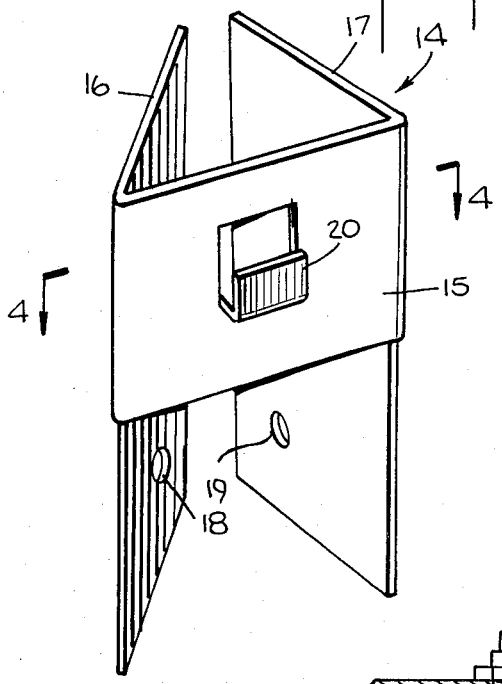
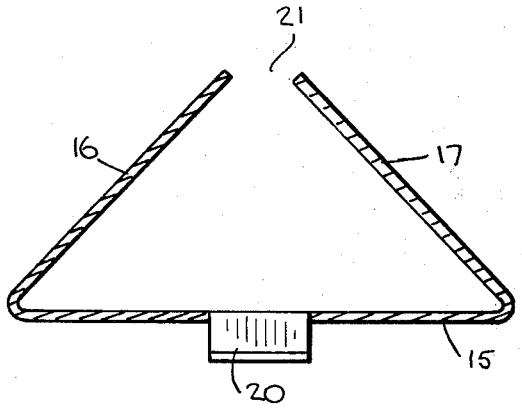
Fig. 4.
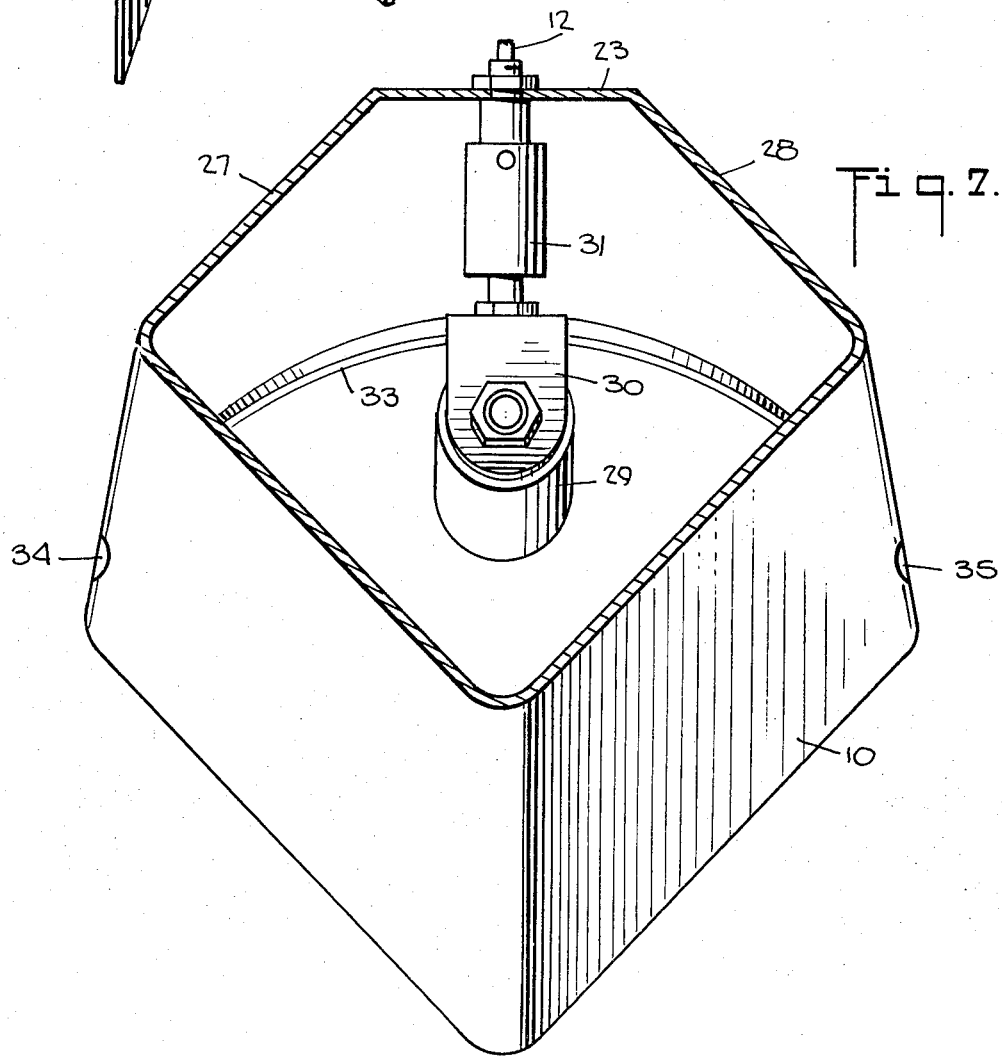
Fig. 7.

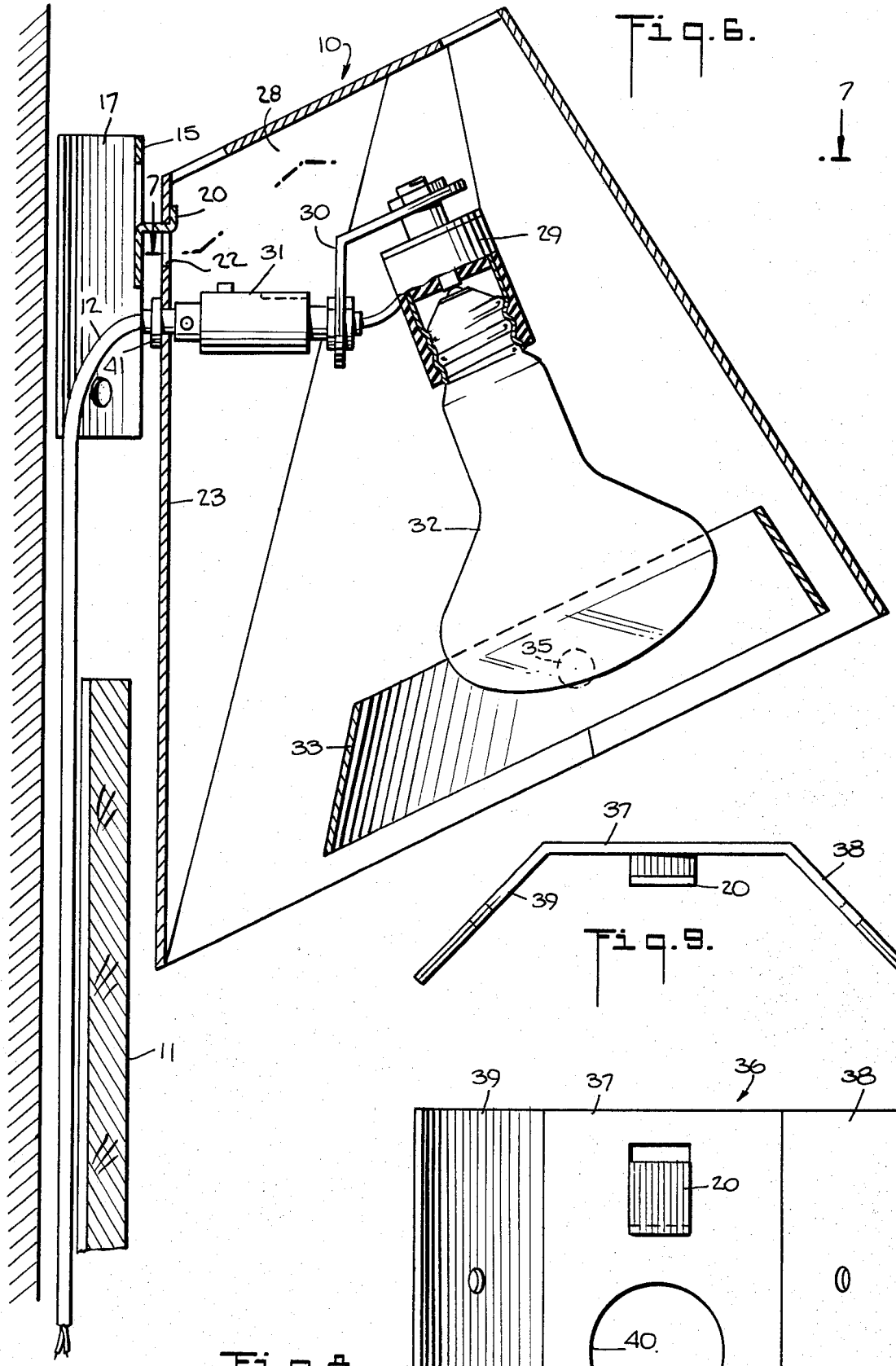
Fig. 6.
Fig. 9.
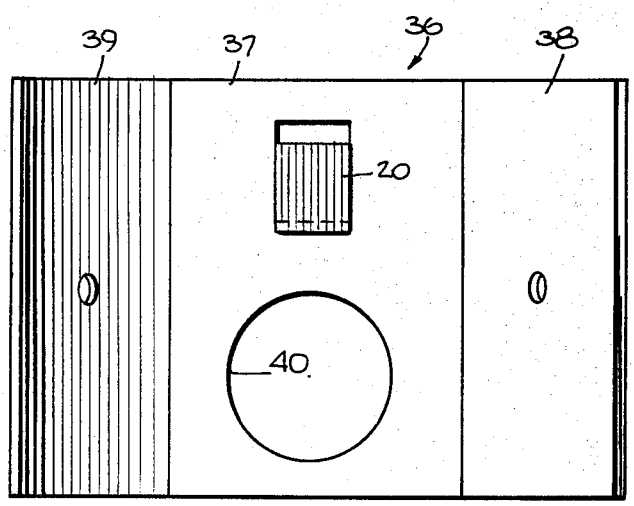
Fig. 8.

CORNER LIGHTING ASSEMBLY

This is a continuation of application Ser. No. 784,137, filed Apr. 4, 1977, now abandoned.

The present invention relates to a corner lighting portable lamp assembly, and more particularly to an assembly for providing horticulturally effective illumination.

With the development of both incandescent and fluorescent lamps having a spectral response suited to the fostering of plant growth, indoor non-commercial horticulture has mushroomed. Plants may be found everywhere, in homes, offices, public buildings and the like. The awkward corner of a room has long been recognized as an ideal location for planting of one form or another. Room corners often represent waste space which the interior designer attempts to decorate in one manner or another. Plants can solve the decorator's problem so long as the concomitant requirement of illumination can be satisfied. Many lighting fixtures are available capable of being lamped with growth inducing bulbs. However, the available fixtures are either costly to install or lacking in esthetic appeal or both. In an ideal corner planting, the plants should constitute the principal decorative object, while the illumination should be unobtrusive and virtually blend into the background.

The objectives of esthetics and symmetry can be achieved by locating the growth inducing lamp in a fixture locatable directly in the corner of the room behind the plants at whatever height is best suited to their particular needs and arranged to direct and concentrate the illumination where required, while blocking direct radiation toward the eyes of people populating the room.

Lamp fixtures adapted to be mounted in the corner of a room for furnishing general illumination are known. One such fixture is described in U.S. Pat. No. 2,800,577 issued July 23, 1957. Said patent describes an incandescent lamp fixture intended to "provide a highly attractive light which will effectively illuminate a wide area". For this purpose the fixture is designed to direct its illumination upwardly and outwardly from the corner of the room. Said fixture has a generally triangular housing with right angled rear walls. Assuming a perfect room corner, said patented fixture is adapted to fit snugly into the corner. However, there is no provision for accommodating any irregularity in the surfaces of the walls of the room adjacent the corner. Moreover, mounting of said fixture requires nails or screws to be passed directly through the rear wall of the fixture into the room wall.

A fluorescent tube type fixture for corner mounting is also known from U.S. Pat. No. 2,428,827, issued Oct. 14, 1947. Again, the purpose of the fixture described in said patent is to provide room illumination, "to illuminate a room by resort to a luminous trimming longitudinally along wall or ceiling surfaces to create the effect of costly custom-built architecturally designed illumination." The fixture consists of a hollow triangularly cross-sectioned or wedge-shaped casing which is closed at its opposite ends. The two rear walls of the casing are at right angles to each other and integrally connected where the walls approach each other by a narrow web angularly related to both walls. The front closure of the casing is formed of a light transmitting material such as glass or plastic while the remainder is of sheet metal.

Mounting is by headed bolts passed through openings in the rear walls of the casing directly into the wall structure of the room. The patent recites that the angularity of the connecting web leaves a space therebeneath "which is desirable since room corners are not always sharply defined."

With the foregoing in mind, it is an object of the present invention to provide a corner light portable lamp assembly which is easily mounted, fits snugly in the corner of a room regardless of irregularities in the adjacent wall surface or corner, is adapted to blend unobtrusively into its surroundings, and provides optimal control and projection of plant growth fostering illumination. In order to provide flexibility of mounting, exposed wiring is employed and decorative means is provided for concealing such wiring.

In accordance with the present invention there is provided a corner lighting portable lamp assembly comprising a bracket member constructed for mounting in a corner of a room at any selected height between the floor and the ceiling. The member has means for securing the bracket to the wall or walls in the corner and a support or bridging member for disposition catercorner across such corner. A shade-like lamp housing is provided containing a bulb socket and constructed and arranged to conceal said socket and any installed bulb from view horizontally while directing in a generally downward direction the illumination from said bulb. The housing has angled rear walls for adapting the same to be located close within the room corner, while the rear of said housing is arranged to complement said support member and to provide clearance between the rearmost part of the housing and said corner of the room. Means are located on the rearmost portion of the housing and on the support member of said bracket for pin-up non-permanent interengagement to secure said housing to said bracket. A flexible electric cord is connected at one end to said socket and passes through said rearmost portion of said housing and is provided with an electric attachment plug at its free end for connecting said assembly to an electric outlet. In addition, there is provided corner molding with means for fastening the same in the corner of the room over the electric cord.

The invention will be better understood after reading the following detailed description of the presently preferred embodiments thereof with reference to the appended drawings in which:

FIG. 4 is a transverse sectional view taken along line 4—4 in FIG. 3;

FIG. 5 is a view similar to FIG. 1, but with the lamp housing removed to show the installed bracket;

FIG. 6 is a vertical sectional view through the lamp housing illustrating the interior details thereof;

FIG. 7 is a sectional view taken along the line 7—7 in FIG. 6;

FIG. 8 is an elevational view of a modified bracket member; and

FIG. 9 is a top plan view of the bracket of FIG. 8.

Reference should now be had to the drawings wherein the same reference numerals are used throughout to designate the same or similar parts.

Figures 1, 2, 3:
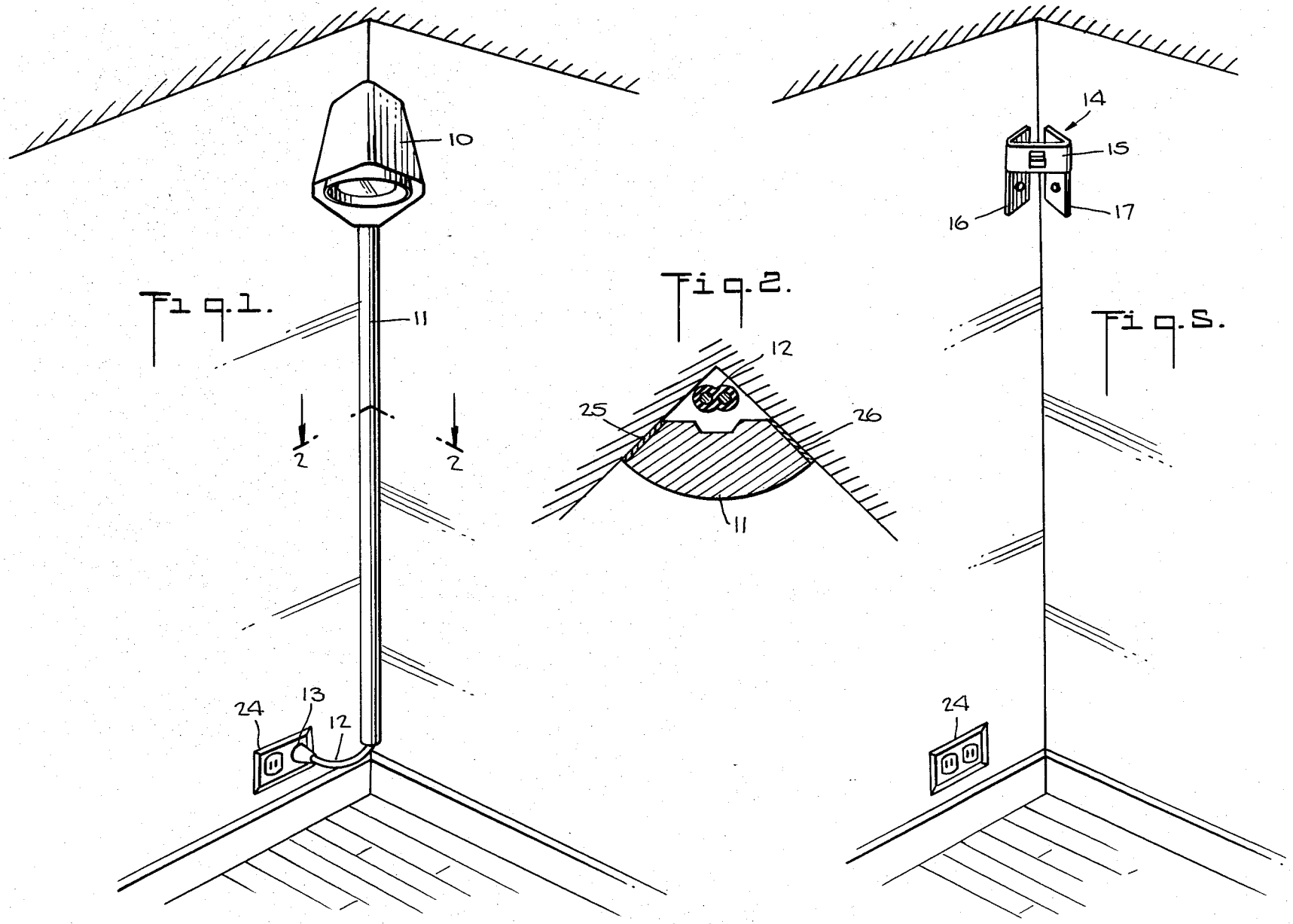
FIG. 1 is a perspective view of a room corner with a typical lighting assembly embodying the invention installed therein.
FIG. 2 is a fragmentary sectional view on an enlarged scale taken along line 2—2 in FIG. 1.
FIG. 3 is a perspective view of one form of bracket member.

The complete installation of the corner lighting assembly is shown in FIG. 1 consisting of a lamp housing 10, corner molding 11, electric lamp cord 12, and plug 13. The lamp housing 10 is supported on a bracket member 14, shown in detail in FIGS. 3 and 4, and in position in the corner of the room, in FIG. 5. As best seen in FIGS. 3 and 4, the bracket member 14 is formed from a U-shape piece of sheet stock, for example, sheet metal, bent to assume a triangular configuration having a front cross member or support portion 15 at the base of an isosceles triangle completed by side arms 16 and 17. The side arms 16 and 17 extend downwardly below the cross or bridging portion 15 providing convenient means for securing the bracket member to the walls of the room in a corner. Nail receiving apertures 18 and 19 are provided, respectively, in the lower portions of arms 16 and 17. It should be appreciated from a consideration of FIG. 5 that the configuration of the bracket is such that the mounting nails or screws may be inserted conveniently through the apertures 18 and 19 close to the corner of the room so as to anchor in the wall studs located thereat.

A hook 20 is formed from the central portion of the support member 15 as clearly illustrated in FIGS. 3 and 4. It should be observed that the arms 16 and 17 terminate short of the intersection of their planes providing a gap between the rear edges at 21. The purpose of this gap is to accommodate slight irregularity in the corner of the room between the walls such that the bracket may be recessed in the corner to its fullest extent.

After the bracket is mounted in the corner of the room, as shown in FIG. 5, at the desired height between the floor and ceiling, the lamp housing 10 can be mounted thereon by interengaging the aperture 22 located in the rearmost wall portion 23 of the housing, see particularly FIG. 6, with the hook 20 on the bracket 14. The lamp cord 12 which exits from the housing through the rear wall 23 will depend therefrom. It is assumed that the cord will be of sufficient length to extend all the way to the floor and then over to a convenient outlet such as the outlet 24 shown in FIGS. 1 and 5.

The assembly can now be completed by cutting to length one or more sections of corner molding 11 and fastening it in the corner of the room by means of adhesive layers 25 and 26 (see FIG. 2) so as to conceal the wire 12. It will be understood that the molding 11 may have any desired decorative face to blend with or conform to the room interior. One length of molding may be used or several pieces end to end.

The lamp housing itself is provided with angled rear walls 27 and 28 for adapting the housing to be located close within the corner of the room. The rear of housing 10 is truncated such that the rearmost portion or wall 23 is spaced from the projected intersection of the sidewalls 27 and 28 providing clearance between the portion 23 and the corner of the room when the housing is installed thereat. It will be understood that the wall 23 should have a width approximately equal to the width of the support member or portion 15 of bracket 14 so that the parts make a close snug fit when interfitted.

As best seen in FIG. 6, the lamp housing 10 encloses a threaded socket 29 mounted on a bracket 30 supported by a standoff 31 from the rear wall 23, as shown. The standoff 31 may be articulable in order to provide for positioning and adjustment of the aim of the socket 29 for controlling the direction of projection of the illumination from the incandescent bulb 32. In order to afford additional control of the illumination, the lamp housing may be provided with an adjustable baffle 33 pivotally joined at 34 and 35 to the sidewall of the housing.

It should be apparent that the bridging member or support portion 15 of bracket 14 extends catercorner across the corner of the room when properly mounted thereat. It should also be understood that bracket 14 may be mounted by suitable adhesive instead of through the use of nails or screws. Moreover, the bracket may contain the hook receiving aperture while the hook may be formed on the lamp housing. Other pin-up type mechanical interengaging means may replace the hook and "eye" as desired.

A modified embodiment of the mounting bracket is illustrated in FIGS. 8 and 9. As shown therein, the bracket 36 has a web or bridging portion 37 extending between the side arms 38 and 39 which are folded outwardly rather than rearwardly as in the bracket of FIGS. 3 and 4. As shown in FIG. 8, an aperture 40 is located in portion 37 to accommodate the external projection of the means 41 for mounting the standoff 31, best seen in FIG. 6. Similar clearance may be provided in the bracket of FIGS. 3 and 4 if required.

Having described the presently preferred embodiments of the invention, it will be understood that various changes in detail of construction may be effected without departing from the true spirit of the invention as defined in the appended claims.

What is claimed is:

1. A corner lighting portable lamp assembly comprising a bracket member constructed for mounting in a corner of a room at any selected height between the floor and ceiling, said member having means for enabling it to be fastened in said corner to adjacent walls of the room and having a support member for disposition catercorner across said corner, a shade-like lamp housing containing a bulb socket and constructed and arranged to conceal said socket and any installed bulb from view horizontally while directing in a generally downward direction the illumination from said bulb, said housing having angled rear walls for adapting the housing to be located close within said corner, the rear of said housing being truncated to provide clearance between the rearmost part of the housing and said corner of the room, means located on the truncated rearmost portion of said housing and on said support member of said bracket for pin-up non-permanent interengagement to secure said housing to said bracket, a flexible electric cord connected at one end to said socket and passing through said rearmost portion of said housing, and an electric attachment plug at the free end of said cord for connecting said assembly to an electric outlet.

2. A corner lighting assembly according to claim 1, wherein there is further provided corner molding with means for fastening the same in said corner over said cord.

3. A corner lighting assembly according to claim 1, wherein said bracket member has arms for engaging the intersecting walls of a room adjacent said corner, and said support member comprises a bridging member extending between said arms for disposition catercorner across said corner.

4. A corner lighting assembly according to claim 1, wherein said means for fastening said bracket member in said corner comprises arms for engaging said walls of the room adjacent said corner and means for fastening said arms to said walls.

5. A corner lighting assembly according to claim 4, wherein said fastening means comprises nail receiving apertures.

6. A corner lighting assembly according to claim 4, wherein said fastening means comprises a layer of pressure sensitive adhesive.

7. A corner lighting assembly according to claim 2, wherein said means for fastening said corner molding comprises a layer of pressure sensitive adhesive on a wall engaging surface of said molding.

8. A corner lighting assembly according to claim 1, wherein said means for securing said housing to said bracket comprise a forwardly projecting hook and a hook receiving aperture, one of which is located on said support member and the other of which is located on said rearmost portion of said housing.

9. A corner lighting portable lamp assembly comprising a bracket member constructed for mounting in a corner of a room at any selected height between the floor and ceiling, said member having means for enabling it to be fastened in said corner to adjacent walls of the room and having a support member for disposition catercorner across said corner, a shade-like lamp housing containing a bulb socket and constructed and arranged to conceal said socket and direct illumination from said bulb, said housing having angled rear walls for adapting the housing to be located close within said corner, the rear of said housing being truncated to provide clearance between the rearmost part of the housing and said corner of the room, means located on the truncated rearmost portion of said housing and on said support member of said bracket for pin-up non-permanent interengagement to secure said housing to said bracket, and a flexible electric cord passing through said rearmost portion of said housing and having an electric attachment plug at its free end for interconnecting said socket with an electric outlet.

10. A corner lighting assembly according to claim 9, wherein there is further provided means for overlying said electric cord and fastening to the walls in said corner of the room for concealing said cord.

11. A corner lighting portable lamp assembly comprising a bracket member constructed for mounting in a corner of a room at any selected height between the floor and ceiling, said bracket member having means for enabling it to be fastened in said corner to adjacent walls of the room and having a support member for disposition catercorner across said corner, a shade-like lamp housing containing a bulb socket and constructed and arranged to conceal said socket and direct illumination from said bulb, said housing having a rear portion for complementally engaging said support member with clearance between said rear portion and said corner of the room and having angled rear walls extending forwardly and divergingly from said rear portion such that said housing is adapted to be located close within said corner, means located on said rear portion of said housing and on said support member of said bracket for pin-up non-permanent interengagement to suspend said housing from said bracket, and a flexible electric cord passing through said rear portion of said housing and having an electric attachment plug at its free end for interconnecting said socket with an electric outlet.

12. A corner lighting assembly according to claim 11, wherein said means for pin-up non-permanent interengagement to suspend said housing from said bracket comprise a forwardly projecting hook and a hook receiving aperture, one of which is located on said support member and the other of which is located on said rear portion of said housing.

* * * * *